US005193359A

United States Patent [19]

Martin et al.

[11] Patent Number: 5,193,359

[45] Date of Patent: Mar. 16, 1993

[54] SPINE FIN REFRIGERATOR EVAPORATOR

[75] Inventors: Jerry C. Martin, Corydon, Ind.; Mark D. Wattley, Prospect, Ky.

[73] Assignee: General Electric Company, Louisville, Ky.

[21] Appl. No.: 818,138

[22] Filed: Jan. 8, 1992

[51] Int. Cl.[5] ..... F25B 39/02

[52] U.S. Cl. ..... 62/515; 165/146; 165/903

[58] Field of Search ..... 62/515; 165/146, 903

[56] References Cited

U.S. PATENT DOCUMENTS

| | | | |
|---|---|---|---|
| 3,046,758 | 7/1932 | Heuer et al. | 62/515 |
| 3,330,336 | 7/1967 | Gobel | 165/146 |
| 3,495,657 | 2/1970 | Keith | 62/515 |
| 3,678,698 | 7/1972 | Gelbard et al. | 62/515 |
| 4,258,782 | 3/1981 | Kao | 165/184 |
| 4,581,800 | 4/1986 | Johnson | 165/184 |
| 4,763,726 | 8/1988 | Failing | 165/146 |
| 4,877,087 | 10/1989 | Hill | 165/184 |
| 5,067,322 | 11/1991 | Beers | 62/515 |

*Primary Examiner*—Ronald C. Capossela

[57] ABSTRACT

A refrigerator includes an evaporator formed from an elongated tube wrapped with a ribbon of material having spine fins extending perpendiculary from the tube. Elongated, horizontal passes of tube are arranged in vertically extending rows defining vertically extending air flow passages. Fins extending into the lower portions of the air flow passages are bent from their perpendicular relationship with the tube.

4 Claims, 2 Drawing Sheets

SPINE FIN REFRIGERATOR EVAPORATOR

BACKGROUND OF THE INVENTION

It is desirable to use a spine fin structure as the evaporator for a refrigerator since spine fins provide a large heat exchange area per unit length of evaporator conduit. This enables the refrigerator manufacturer to minimize the size of the evaporator and thus maximize the useable storage space of the refrigerator. The air being refrigerated by the evaporator is laden with moisture and the evaporator normally operates at frost collecting temperatures. This air flows around the fins and frost tends to quickly build up on the inlet end of spine fin evaporators. The evaporator must be defrosted fairly often and the overall operating efficiency of the refrigerator is reduced.

Accordingly, it is an object of this invention to provide refrigerator with an improved spine fin evaporator.

It is another object to provide such an improved structure in which the evaporator is more tolerant of frost build-up without significant degradation of the evaporator efficiency.

It is a further object of this invention to provide such a structure in which the spine fin evaporator defines open passages for the build-up of frost.

SUMMARY OF THE INVENTION

In accordance with one form of the invention there is provided a refrigerator with a vertically extending evaporator chamber through which air flows from the bottom to the top. An evaporator is formed from a tube having spine fins projecting perpendicularly outward of the tube. The tube is positioned in the chamber with horizontally extending passes of tube arranged in vertical rows which define vertical extending air passages. The fins extending into the lower portions of the passages are bent from the perpendicular to provide open passage portions.

DESCRIPTION OF THE PREFERRED EMBODIMENTS

Figure 1:
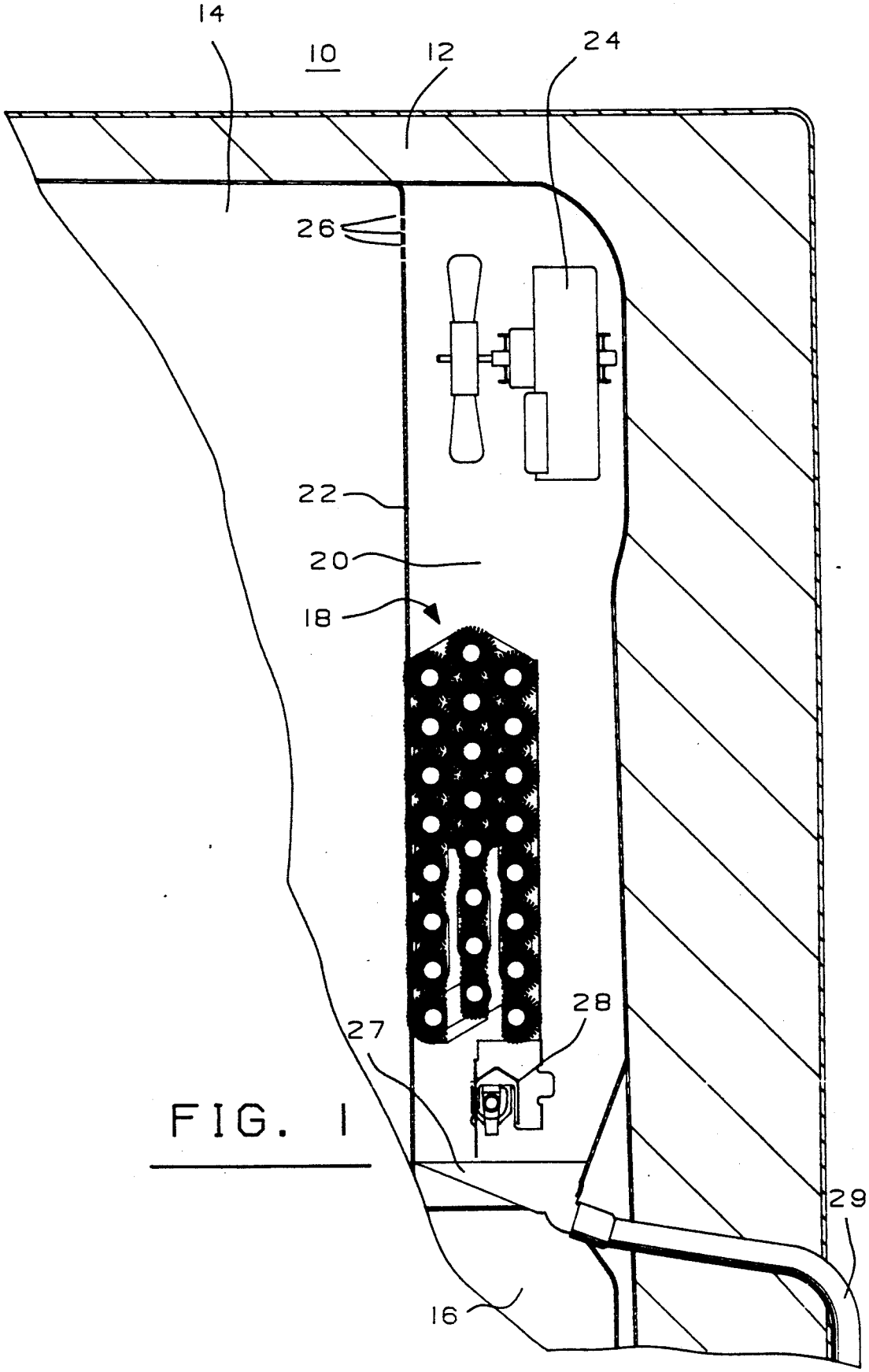
FIG. 1 is a fragmentary cross-sectional side elevational view of a refrigerator incorporating one form of the present invention.

Referring now to FIG. 1, a refrigerator 10 includes an outer cabinet 12 containing a freezer compartment 14 and a fresh food compartment 16. The freezer is maintained at below freezing temperatures and the fresh food compartment is maintained at above freezing-food preserving temperatures by circulating air through these compartments and over an evaporator 18 located in a vertically extending evaporator chamber 20 positioned behind the freezer compartment and separated from it by a wall structure 22. More specifically, a motor driven fan 24 is positioned in the upper portion of the evaporator chamber and discharges air through openings 26 in wall 22 into the freezer. From the freezer some of the air flows through a passage, not shown, into the fresh food compartment 16. The fan 24 also draws air from the freezer and fresh food compartments into the lower portion of the evaporator chamber and thence upwardly over the evaporator. The freezer is maintained at below freezing temperatures and the fresh food compartment is maintained at above freezing temperatures by an appropriate division of the cooling air, as is well known in the art.

In order to maintain the appropriate temperatures in the freezer and fresh food compartments it is necessary that the evaporator 18 operate at below freezing temperatures, with the result that moisture contained in the air returning from the freezer and fresh food compartments condenses on the evaporator in the form of frost. Periodically the accumulated frost is removed from the evaporator surfaces by energizing a heater 28 positioned in radiant and convection heating relationship with the evaporator surfaces.

Refrigerator evaporators transfer heat from the air passing over the outside surfaces of the evaporator to the refrigerant flowing through the inside of the evaporator tube so as to cool the air. In order to enhance this heat transfer, it is well known to provide some type of fins extending outwardly of the evaporator tube and spine fin evaporators are very effective heat transfer structures. However, as the spine fins typically are spaced closely together and the tube is bent into a serpentine or similar structure the air flows through numerous small labyrinth paths around the individual fins. Thus, spine fin evaporators may be susceptible to rapid build-up of frost on the surfaces first encountered by the air returning from the fresh food and freezer compartments. If this build-up of frost closes off the various labyrinth paths, the air will tend to take the path of least resistance and flow around the evaporator. This reduces the cooling effect of the evaporator and requires frequent defrosting, both of which reduce the overall efficiency of the refrigerator.

Figure 5:
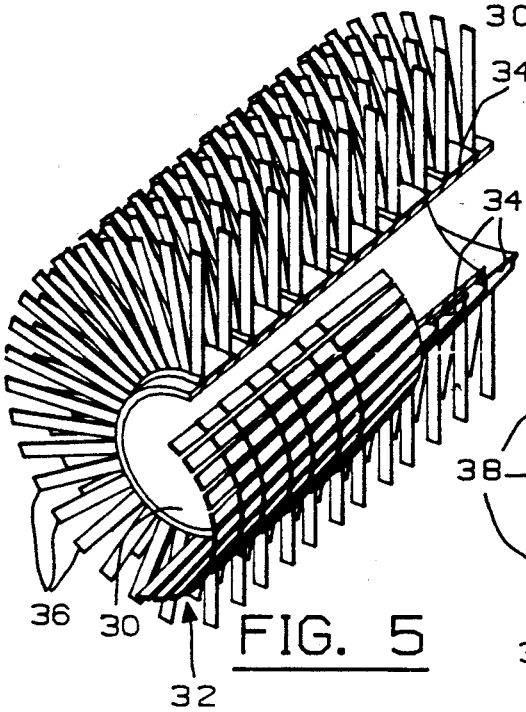
FIG. 5 is a fragmentary view of a section of evaporator tube illustrating additional details of a bent fin configuration.
Figure 2:
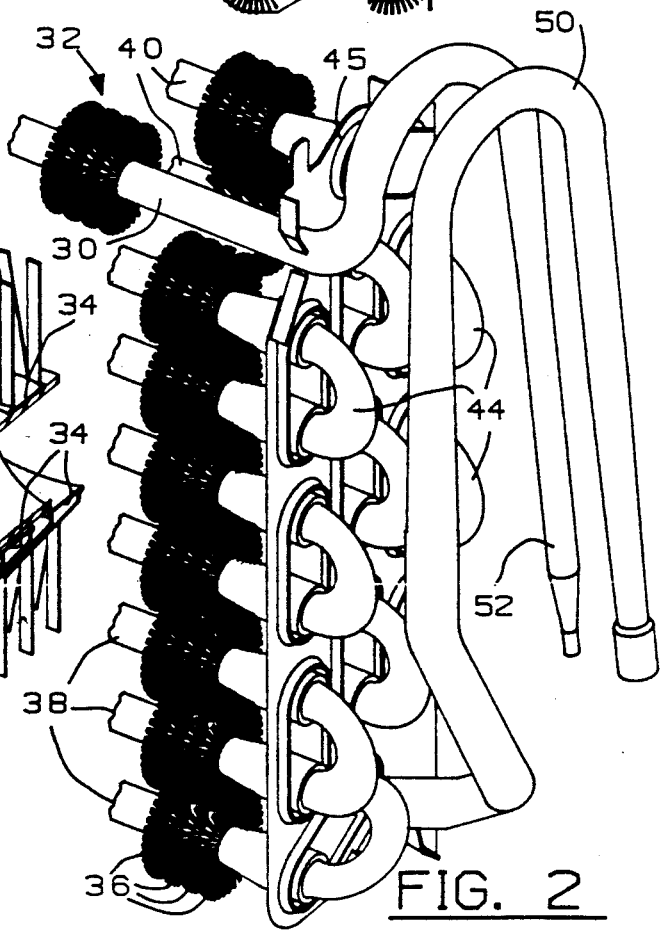
FIG. 2 is a fragmentary perspective view of the evaporator of FIG. 1.

As best seen in FIGS. 2 and 5, the evaporator 18 is formed from an elongated tube or conduit about which is wrapped an elongated ribbon 32 of spine fin material. The ribbon 32 includes a base 34 with integral fins 36 extending outwardly from each of its lateral edges. The ribbon 32 is bent so that, when the base 34 is wrapped around the tube 30, the fins 36 project generally perpendicularly outward of the tube. Typically the ribbon is wrapped in an open spiral with adjacent passes of the ribbon around the tube spaced apart. U.S. Pat. No. 5,067,322 issued on Nov. 26, 1991, for David G. Beers, and assigned to General Electric Company, assignee of the present application illustrates and describes in more detail spine fin evaporator structures useful in refrigerators and is incorporated herein by reference.

Figure 3:
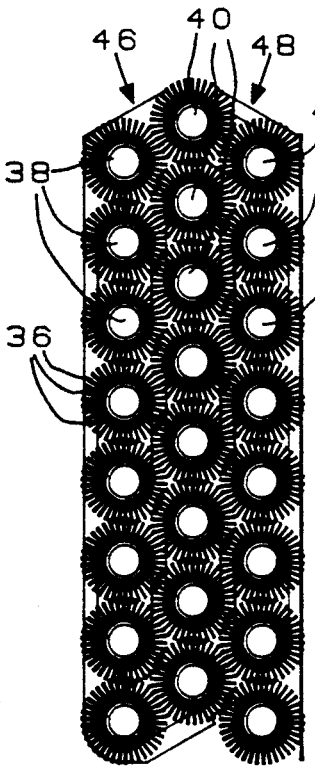
FIG. 3 is a cross-sectional view of the evaporator of FIG. 2 before the fins are bent from their perpendicular orientation.
Figure 4:
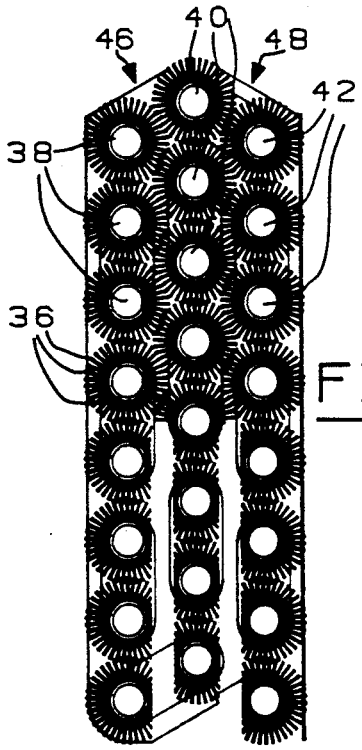
FIG. 4 is a cross-sectional view similar to FIG. but illustrating a bent fin configuration.

Viewing now particularly FIGS. 2–4, the tube 30 is bent to form the evaporator 18 as a compact structure. More particularly the tube is formed into straight runs or passes 38, 40 and 42 respectively, connected by return bends 44. The tube is first bent into a continuous serpentine form and then the serpentine is bent so that the passes 38 form a first row or tier of evaporator tubing, the passes 40 form a second row or tier and the passes 42 form a third tier. The adjacent passes, both in the same row and in adjacent rows, are spaced closely together so that the fins overlap. The evaporator is mounted in the refrigerator with the rows positioned substantially vertically, that is, the passes 38, 40 and 42, respectively, form vertical rows or tiers of tube. The space between each pair of adjacent rows, 38-40 and 40-42 form vertically extending air passages 46 and 48 respectively. Since the fins 36 overlap, the air passages are in the form of a multitude of labyrinth paths., The ends of the tube are free of spine fin ribbon and serve as entry and exit sections 50 and 52 respectively to connect the evaporator in the hermetic refrigeration system.

The air circulating upward through the evaporator chamber 20 flows around the tube passes and fins, principally through the air passages 46 and 48. Moisture entrained in the air flow tends to deposit on the outer surfaces of the evaporator, principally across the bottom as that is the first below freezing structure contacted by the moisture. If a layer of frost builds up there, it will restrict the lower ends of the air passages 46 and 48 and the air will tend to flow around the outside of the evaporator, with a resultant reduction in the cooling effect.

In order to provide sufficient area to collect a significant amount of frost without decreasing effective cooling by the evaporator, part of the fins are bent over out of their perpendicular relationship with the tube. More particularly a tool or mandrel is inserted into the lower portion of each of the air passages 46 and 48 and moved along the length of the tube passes 38,40 and 42 to bend the fins over, as best seen in FIG. 5. Those fins extending from the tube areas immediately adjacent the passages preferably are bent over essentially ninety degrees to be generally parallel to the tube, Those fins which extend into the passages from more remote portions of the tubes are bent to lesser degrees.. This results in the lower portions of the air passages 46 and 48 being open and capable of accumulating substantial amounts of frost before clogging.

The number of fins bent over out of their perpendicular relationship with the tube, as well as the location of the bent over fin areas, should take into account both the ability to accumulate frost and the cooling effectiveness of the evaporator when not frosted. For example, in evaporators in which the tubing is formed into vertical rows defining vertical extending air passageways, it generally is advisable to bend over fins at the air entry end of each air passageway. This prevents any passsageway from quickly becoming blocked with frost. On the other hand, since air follows the path of least resistance, it is not advisable to bend over the fins along the entire length of the air passages, lest the air merely flow up the passages without engaging the other fins. We have found that with a compact evaporator structure as illustrated herein, optimum results are obtained when the fins are bent over in no more than about the lower half of the air passages.

While there has been shown and described what is presently considered to be the preferred embodiment of this invention, it is to be understood that the invention is not limited thereto and it is intended in the appended claims to cover all such changes and modifications as fall within the true spirit and scope of the invention.

What is claimed is:

1. In a refrigerator:

wall means defining an evaporator chamber and means for causing air to flow through said chamber;

a refrigerant evaporator formed from an elongated tube with a ribbon of spine fin material wound about the outer surface of said tube so that individual fins of said ribbon extend generally perpendicularly outward of said tube, said tube being arranged in said chamber in a plurality of elongated tube passes extending substantially perpendicular to the direction of air flow through said chamber;

said tube passes being arranged in a plurality of elongated rows generally parallel to the direction of air flow, said rows being spaced apart less than twice the length of said fins and defining an elongated air flow channel between adjacent rows; and at least some of the fins projecting into the portion of said channel first exposed to the air flow being bent from the perpendicular to provide an open channel portion with improved tolerance to frost build-up.

2. The combination as set forth in claim 1, wherein:

fins are bent in no more than about one half the length of said rows.

3. In a refrigerator:

wall means defining a vertically extending evaporator chamber and means for causing air to flow upwardly through said chamber;

a refrigerant evaporator formed from an elongated tube with a ribbon of spine fin material wound about the outer surface of said tube so that individual fins of said ribbon extend generally perpendicularly outward of said tube, said tube being arranged in said chamber in a plurality of elongated tube passes extending substantially horizontally across said chamber, said passes being arranged in a plurality of generally vertical rows so spaced that fins of adjacent passes of tube overlap;

said rows of passes defining at least one vertically extending air flow channel intersected by a plurality of said fins; and the fins projecting into the lower portion of said at least one channel being bent from the perpendicular to provide an open portion of said channel.

4. The combination as set forth in claim 3, wherein:

said at least one open channel portion extends no more than about half the vertical length of at least one air flow channel.

* * * * *